United States Patent [19]

Hancovsky

[11] Patent Number: 4,607,417

[45] Date of Patent: Aug. 26, 1986

[54] STORAGE SYSTEM FOR CREMATED REMAINS

[75] Inventor: John P. Hancovsky, McMurray, Pa.

[73] Assignee: Matthews International Corporation, Pittsburgh, Pa.

[21] Appl. No.: 553,747

[22] Filed: Nov. 21, 1983

[51] Int. Cl.[4] ..... A61G 17/08; E04H 13/00

[52] U.S. Cl. ..... 27/1; 27/7; 52/137; 206/486; 220/355

[58] Field of Search ..... 27/1, 14, 7; 52/128, 52/136, 137, 139; 220/355; 206/486, 489, 490, 562, 563

[56] References Cited

U.S. PATENT DOCUMENTS

| | | | |
|---|---|---|---|
| 2,884,283 | 4/1959 | Korol et al. | 384/439 |
| 3,165,227 | 1/1965 | Crowell et al. | 220/355 |
| 3,183,574 | 5/1965 | Diem | 27/1 |
| 3,754,805 | 8/1973 | Pangburn et al. | 312/111 |
| 3,806,721 | 4/1974 | Murphy | 362/311 |
| 3,997,948 | 12/1976 | Hicks et al. | 27/2 |
| 4,226,456 | 10/1980 | Barnett | 294/1.3 |

*Primary Examiner*—Robert A. Hafer
*Assistant Examiner*—Terrence L. B. Brown
*Attorney, Agent, or Firm*—Parmelee, Miller, Welsh & Kratz

[57] ABSTRACT

An urn-like cannister for storing and transporting cremated remains, preferably of a molded plastic material, includes a pliable lid with sealing edges for enclosure of the remains in a substantially water and air tight environment. The cannister has a flanged portion around its top periphery and tapered locking tabs outwardly extending on its sidewalls and in spaced relationship to the cannister flange. The cannister is adapted to be inserted into one of an array of like openings formed in a niche plate, of a type having a recessed flange surrounding each niche opening. Upon insertion, the flange and locking tabs of the cannister engage opposing surfaces of the niche plate flange to securely hold the cannister in place. The niche plate opening is then closed by a scroll plate which is attached to the niche plate by threaded tamper proof fasteners.

8 Claims, 10 Drawing Figures

STORAGE SYSTEM FOR CREMATED REMAINS

This invention relates generally to the interment of cremated remains and, more particularly, to an urn-like canister construction for holding such remains and a niche plate configuration adapted to lockably receive and store said canister in one of an array of like cremation niches for use in both indoor and outdoor interment environments.

DESCRIPTION OF THE PRIOR ART

There are several ways in which cremated remains are commonly stored for memorialization purposes. Decorative memorial urns are usually stored indoors in a repository structure in a permanent, side-by-side niche arrangement formed in or along the walls of a building. The decorative urns of varying shapes are placed in the niches and generally glass covers are placed over the openings of the niches for viewing purposes. Such an urn-niche repository is referred to as a columbarium. Closed-faced niches are also used in columbaria and these are usually covered with face plates of bronze, marble or granite, which may carry personalized memorial inscriptions pertaining to the deceased. In such closed faced niche interment, a less expensive, non-decorative urn-like container may be used. Urns containing cremated remains are also stored outdoors in closed-faced niches formed in vertically standing walls or in horizontally situated interment arrays.

Various framed or modular structures have heretofore been proposed for storing urns, such as those depicted in U.S. Pat. Nos. 3,183,574; 3,529,730 and 3,754,805 but they have proved to be unduly expensive and complex to manufacture and construct. In an order to reduce costs, without sacrificing the esthetic appearance of closed-faced niche repositories, it has been proposed to make the niche openings and non-decorative containers of a standardized size. One such commercial construction utilizes a flat niche plate of cast bronze having a plurality of niche openings formed therein with flanged, urn-like containers pre-bolted to the underside of the plate at each niche opening. The aforementioned flat, niche plate is secured to masonry sidewalls either in a vertical or horizontal plane forming an open interior beneath the plate for the urn-like containers. In this prior system, the cremated remains are first placed into a plastic bag after cremation, and the bag is tied shut and then placed into the urn-like container carried by the niche plate. A neoprene gasket is then positioned around the outer surface of the niche opening and a first cover plate is secured by screws thereto in order to prevent water seepage from the outer surface of the niche plate into the container. A face plate or scroll plate is finally secured over the first cover plate to complete the interment procedure. While this commercially used system has successfully reduced expenses over the previously mentioned storage constructions, it nevertheless also possesses several inherent shortcomings. The plurality of urn-like containers are fastened to the underside of the heavy niche plate prior to the securement of the plate to the sidewalls of the repository. Usually six holes are drilled and tapped around the periphery of each niche opening in the plate and the flanged containers are then secured thereto by way of screws. Due to the fact that this final assembly operation takes place in the field, coupled with the fact that the clearances between adjacent containers is quite small, some screws are occasionally not sufficiently tightened around the niche opening to ensure a snug fit between the container flange and the underside of the niche plate. When this occurs in outdoor installations, water may seep between the flange and the underside of the niche plate into the container causing either unwanted contamination within an occupied container or an unsightly appearance to an unused container which is freshly opened. Ideally, the urn-like containers should be water and air tight in order to preserve the cremated remains in a dignified, memorialized environment. Additionally, this prior repository system requires handling of the plastic bag containing cremated remains at the interment location, since the urn-like containers are premounted beneath the niche plate. Needless to say, this bag transfer operation cannot easily be carried out in a tasteful manner for the purposes of achieving a dignified memorial service at the interment site. A further problem is present if it is necessary, at a later time, to move the cremated remains to a different interment location. Once again, the bag containing the remains must be separately withdrawn from the fixed urn-like container for transport in a second container, with the attendant problems of handling a plastic bag which may have become weakened through degradation over time from exposure to air and water.

SUMMARY OF THE INVENTION

My invention solves many of the problems heretofore encountered in the prior art by providing a transportable urn or canister with sealing lid for storing cremated remains in a nearly air and water tight environment, which is adapted to be lockably secured within a flanged niche plate without the use of sealing gaskets, screws or other fasteners. My invention further provides a standardized size of urn and niche opening to maximize space utilization while reducing costs, improving function and maintaining the high degree of esthetic qualities required. The urn-like canister of my invention is also removable from the niche plate should it be necessary to move the cremated remains to another location.

Briefly, my invention comprises an urn or canister, molded of plastic, having an outwardly extending, flanged portion near its top edge and a plurality of tapered locking tabs situated on the outer sidewalls in space apart relationship to the flange. The top edge of the canister has a detent formed around its inner circumference which sealably engages a mating edge formed in a pliable, plastic lid. The niche plate is preferably cast from a bronze alloy and has a plurality of niche openings formed therein of a shape corresponding to that of a tranverse cross-section of the canister. Each of the niche openings terminate in a recessed flanged portion which is adapted to lockably receive the canister therein. Upon insertion, the canister flange bears against the outer surface of the niche flange while its locking tabs bear against the inner surface of the niche plate flange, securely holding the canister within the niche opening. A decorative scroll plate, preferably of cast bronze alloy, covers the niche opening and is attached to the niche plate by two tamper proof screws to complete the installation.

BRIEF DESCRIPTION OF THE DRAWINGS

The above, as well as the other features and advantages of the present invention will become more apparent through consideration of the detailed description in connection with the accompanying drawings, in which.

DETAILED DESCRIPTION OF THE INVENTION

Figure 1:
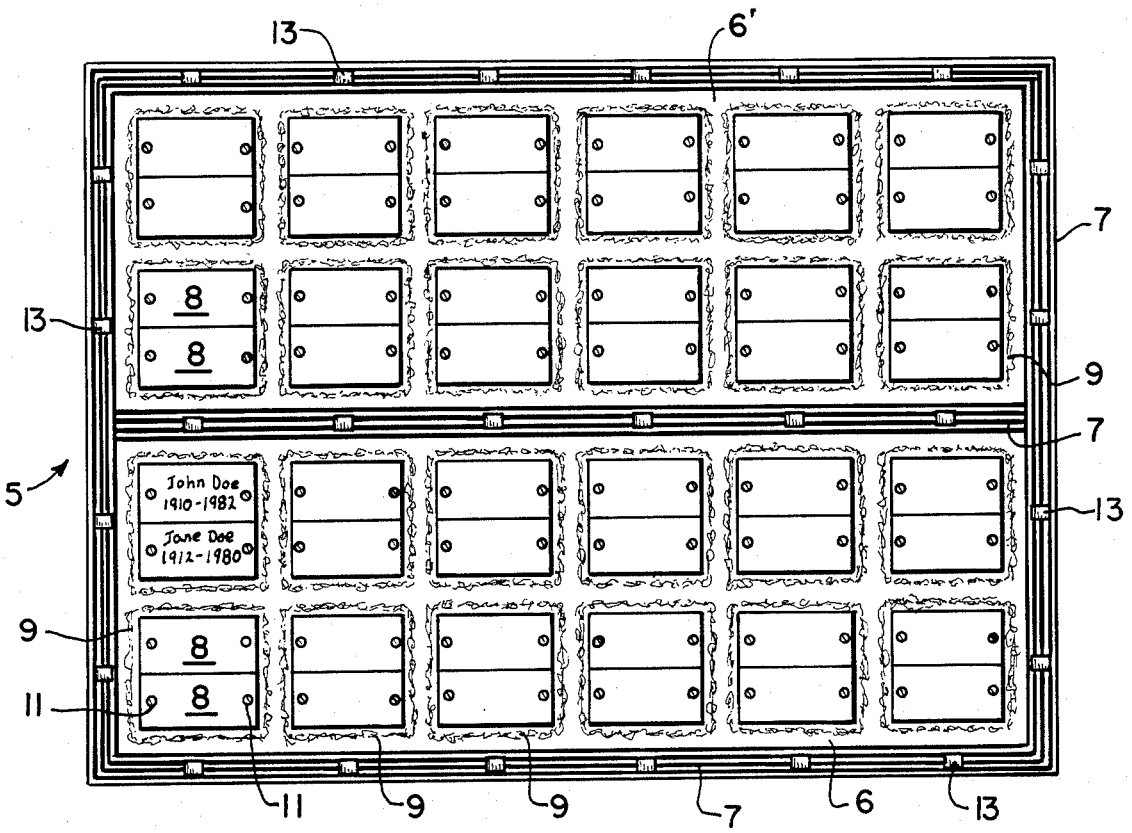
FIG. 1 is a plan view of an urn repository showing a plurality of scroll plates in place thereon.

Referring now to the drawings, and specifically to FIG. 1, a repository 5 for storing cremated remains is depicted as it would appear in a fully assembled condition. The repository 5, in outward appearance, is similar to one of the prior art assemblies referred to above, of the type having a standardized niche opening size with closed-faced scroll plates, i.e. non-viewing. As previously mentioned, such repositories, some of which are referred to as columbaria, may be vertically standing along a wall, or horizontally situated, located either indoors or outdoors.

Figure 2:
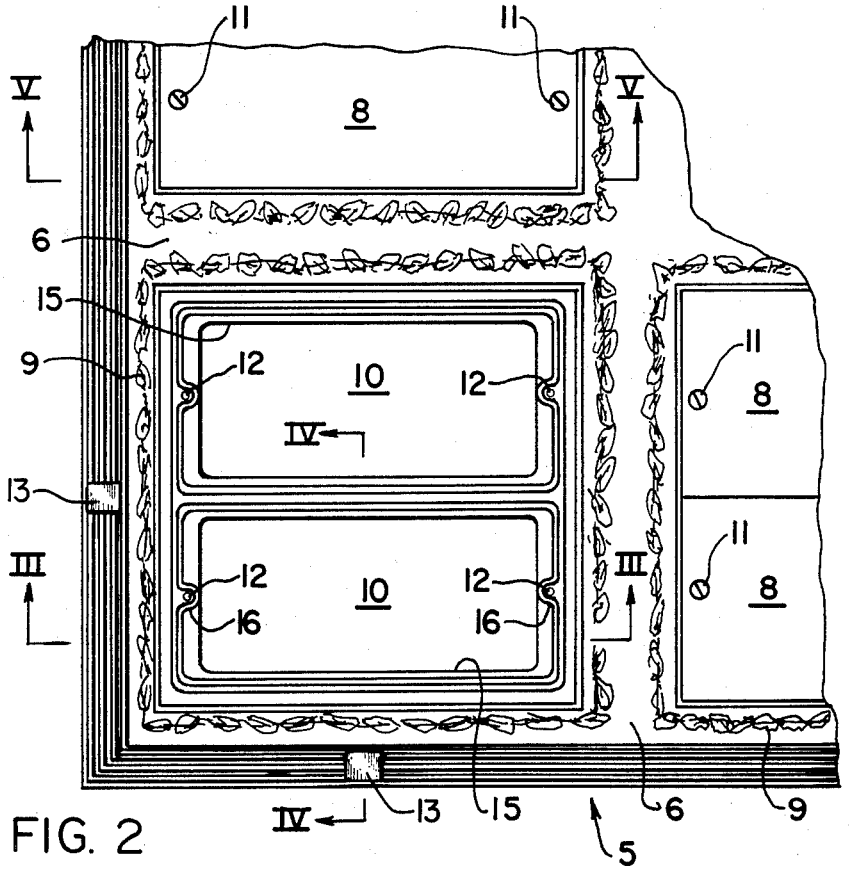
FIG. 2 is an enlarged, fragmentary plan view similar to FIG. 1 in which two of the scroll plates have been removed.

The repository 5 comprises two flat niche plates 6 and 6′ preferably cast from a bronze alloy, has a plurality of spaced-apart niche openings 10 formed therein, FIG. 2. The niche openings are preferably surrounded by a decorative border 9 of ivy leaves or the like which is cast into the niche plate 6. Each niche opening 10 is covered by a scroll plate 8, also preferably of cast bronze, which is secured by two tamper proof screws 11, within a pair of tapped holes 12 in the niche plate 6. Due to the substantial weight of bronze castings, the niche plates 6 and 6′ are cast in modular sections such as in the manner depicted in FIG. 1, wherein each plate provides twelve "companion" burial spaces or twenty-four standard sized niche openings 10. As can be seen, the entire repository 5 of FIG. 1 accommodates a total of forty-eight individual "enurnments", the term used to describe the interment of an urn containing cremated remains. It is of course appreciated that other configurations are easily obtained by cutting the niche plate into smaller segments or by casting it into any other desired segmented array, all of which is known in the prior art.

The peripheral and abutting edges of the niche plates 6 and 6′ are covered by decorative metal strips 7 which, in turn, are secured to the niche plates 6 and 6′ by a plurality of drive pins or bolts 13. Fasteners 13 are secured to lead inserts 17 imbedded within the outer faces of sidewalls 14 of the repository 5, FIGS. 3–5. The sidewalls 14 are preferably of masonry such as concrete block, brick, precast or form-cast concrete and the like, and define the outer periphery of the repository 5. Sidewalls 14 are formed of a sufficient depth to permit the accommodation of an urn-like canister 20 beneath the niche plate 6, FIG. 5. The inner surface 18 of the closed interior 19 of repository 5, beneath sidewalls 14 and niche plate 6, usually comprises a bed of gravel, or like granular material, to provide good drainage for horizontally arrayed, outdoor installations. In vertical installations, the inner surface 18 could comprise an existing building wall or other specially constructed wall, either indoors or out, in a manner well known in the art.

A presently preferred embodiment of the urn-like canister of my invention, designated by the reference number 20, is depicted in FIGS. 5–10. Unlike the prior art, my canister 20 does not form a part of the niche plate assembly at the time of initial repository construction, but, rather, it is separate therefrom until such time as it is used for the actual interment or shipment of cremated remains. Canister 20 is preferably constructed of a plastic material such as polyethylene, polypropylene or like polymeric material, which is resiliently rigid and waterproof. In the preferred embodiment shown in the drawings, canister 20 is rectangular in transverse cross-section, having opposed wide sidewalls 21, opposed narrow sidewalls 22, an integral closed bottom end 23 and an open top edge 24. Dimensionally, canister 20 is about twelve inches in length and has an interior container volume which will accommodate approximately two hundred and ten cubic inches of cremated remains.

Figure 8:
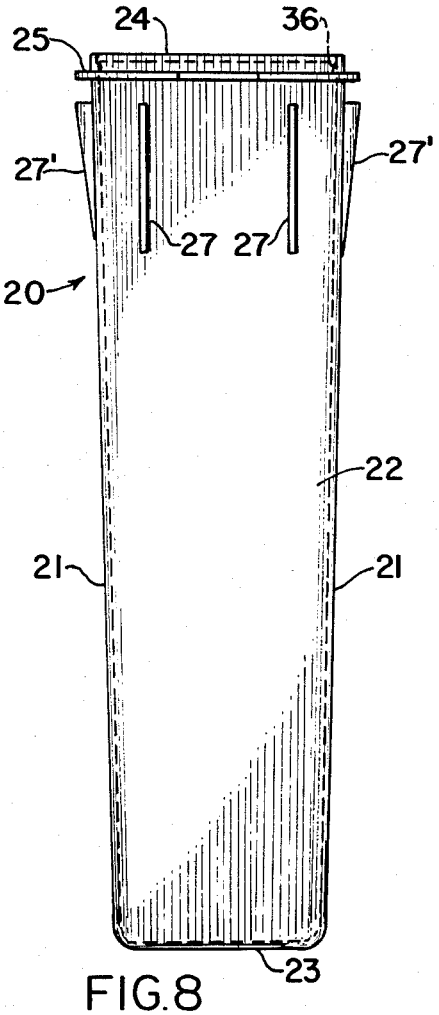
FIG. 8 is a side elevation of a canister similar to that of FIG. 6.
Figure 9:
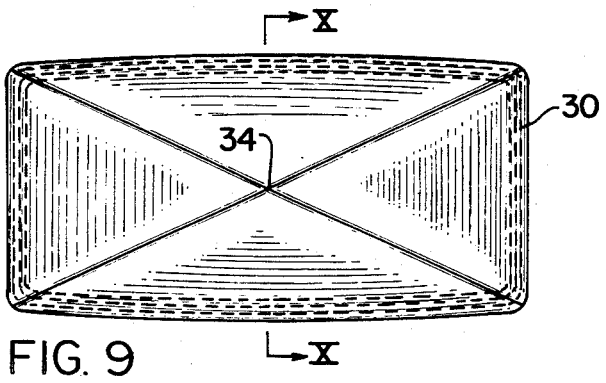
FIG. 9 is a plan view of the canister lid.
Figure 10:
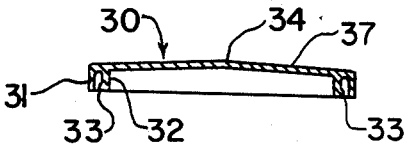
FIG. 10 is a cross-sectional view of the canister lid taken along line X—X of FIG. 9.

An outwardly projecting flange 25 is formed around the periphery of the canister 20 adjacent to and spaced below the top edge 24 thereof. The flange 25 contains two cut-out portions 26 adjacent opposed sidewalls 22, the function of which will become apparent hereinafter. A plurality of tapered locking tabs 27 or 27′ are formed on the sidewalls 21 and/or 22 of the canister 20, each of which includes a sharp shoulder portion 28 that is in spaced relationship below the flange 25 and a tapered, terminal end 29 that blends with the sidewalls 21 and 22. The locking tabs 27 and 27′ may be employed either on the wide sidewalls 21 or on the narrow sidewalls 22, as shown in FIG. 6, or on both, as shown in FIG. 8. As will become more apparent with reference to FIG. 5, the spacing between the shoulder 28 of the locking tabs 27 and the flange 25 is slightly larger than the thickness of the niche plate flange 15 so as to ensure a snug, locking fit when the canister 20 is inserted into the niche plate opening 10. The taper of tabs 27 and 27′ also provides for smooth insertion and positive locking action.

An improved air tight seal within the canister 20 is achieved through the use of a pliable, plastic lid 30 which sealably engages the top edge 24 thereof. The inner surface of the canister edge 24 contains a grooved detent 36, formed preferably during the plastic injection molding operation, to improve sealing engagement with the lid. The lid 30, depicted in FIGS. 9–10, comprises a slightly crowned, outwardly convexshaped, surface portion 37 having its highest point at the center 34, which feature prevents water from accumulating thereon in outdoor repositories. Surface portion 37 carries outwardly extending outer and inner lipped edges 31 and 32, respectively. The lips 31 and 32 snugly engage the top edge 24 around the entire perimeter of the canister 20 so as to provide a tight seal thereabout. In order to improve the sealing and locking interaction between lid 30 and canister 20, the inner lid lip 32 preferably carries an outwardly extending, molded ledge or bead 33 which mates with the detent 36 of the canister edge 24 when the lid is pressed into sealing engagement therewith. Hence, an improved, tight seal is obtained without the necessity of the sealing gaskets or mechanical fasteners of the prior art.

The above-described lid and canister not only provides superior, permanent urn storage for cremated remains, but it can also function as a transportable shipping container for cremated remains due to its compact, sealed construction. The outward appearance of the canister 20 is enhance by the addition of a memorial decoration 35, shown as a wreath of olive branches in FIG. 6. This or other desired memorial decorations are easily applied to the canister sides 21 by a conventional hot transfer stamping process, well known in the plastics art.

In the use of my invention, the cremated remains are placed into a plastic bag at the site of cremation. The top of the bag is closed with a conventional flexible tie and the filled bag is then placed into the canister 20 and the lid 30 is tightly sealed thereto. The canister 20 containing the cremated remains may then be transported to its interment destination. Due to its dignified appearance, the canister 20 may be viewed during the interment service which, as previously noted is a highly distasteful experience when only the bag is used.

Figure 3:
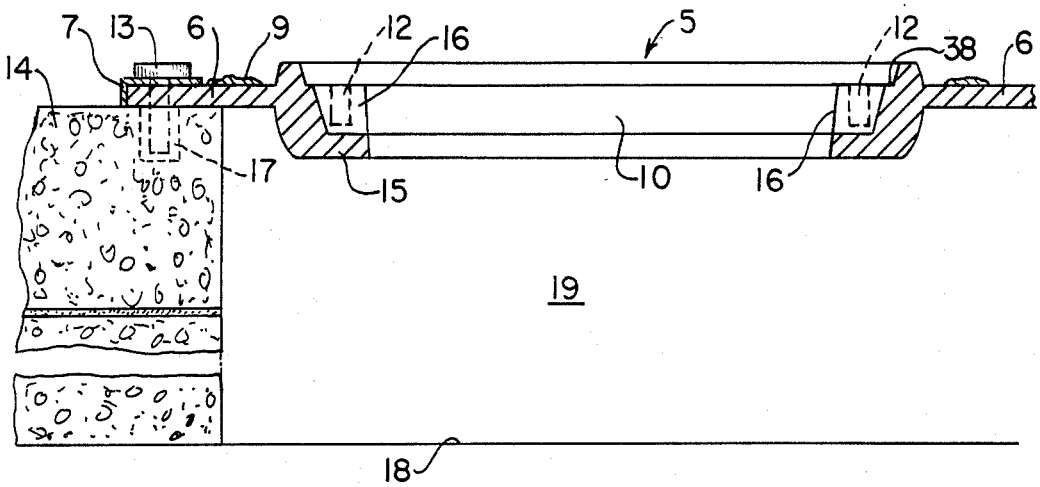
FIG. 3 is a cross-sectional view of the niche plate of the present invention taken along line III—III of FIG. 2.
Figure 4:
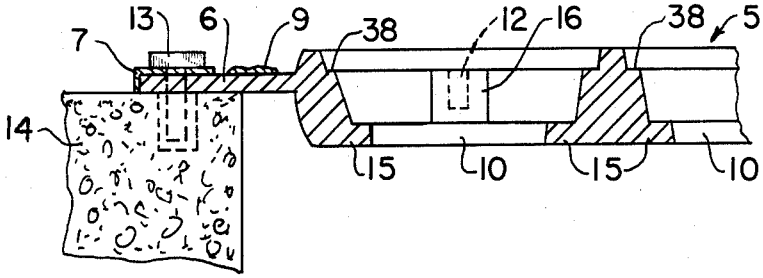
FIG. 4 is a cross-sectional view of the niche plate taken along line IV—IV of FIG. 2.
Figure 5:
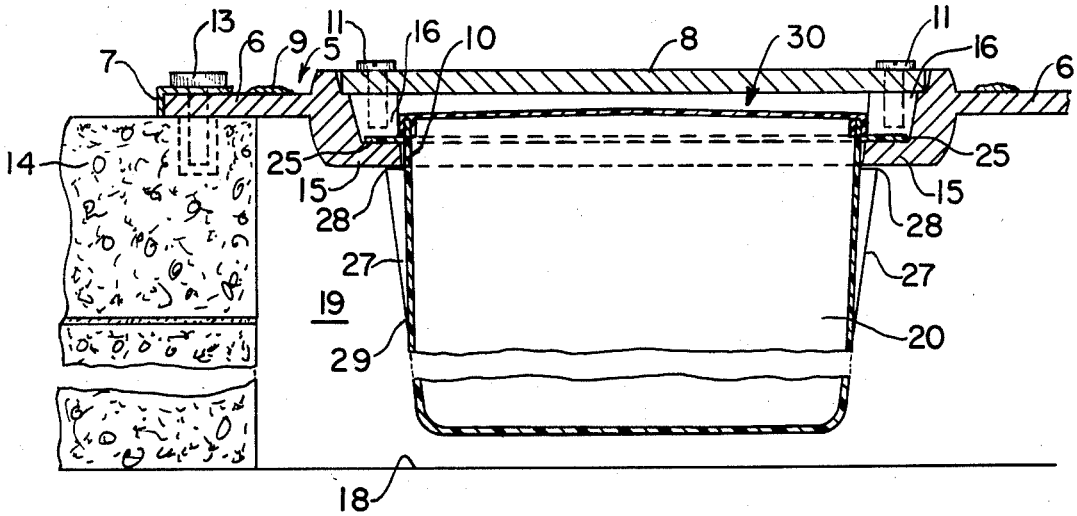
FIG. 5 is a cross-sectional view of the niche plate and urn-like canister of the present invention with the scroll plate attached taken along line V—V of FIG. 2.
Figure 7:
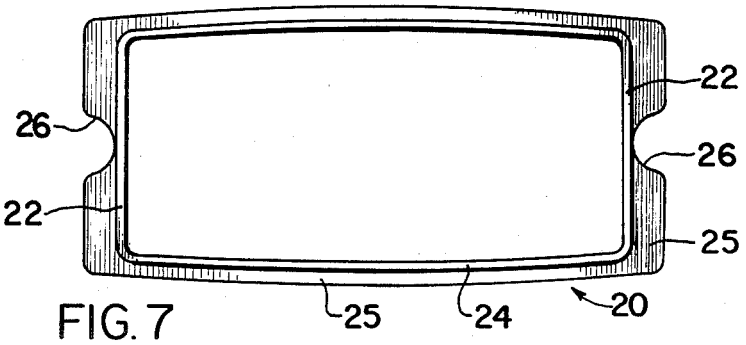
FIG. 7 is a top plan view of the canister of FIG. 6.
Figure 6:
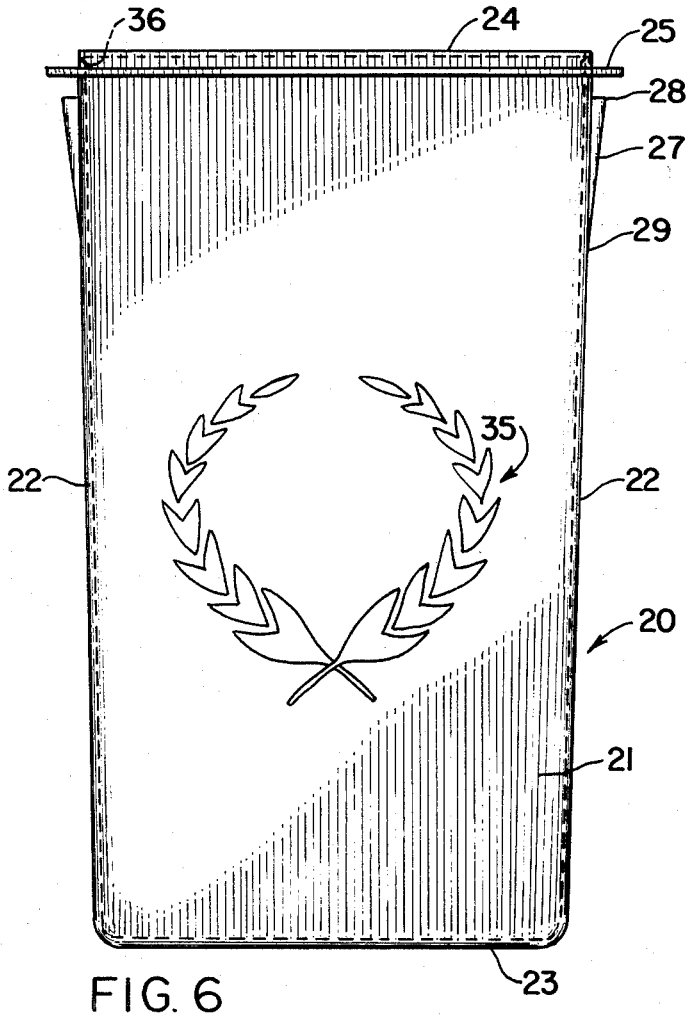
FIG. 6 is a front elevation of the urn-like cannister of the present invention.

At the repository site, and particularly referring to FIGS. 3–5, the scroll plate 8 is removed from the niche plate 6 by removing the two hold down screws 11. The scroll plate 8 usually contains memorial information such as the name, birth date and date of death of the deceased, in the customary manner.

Each niche plate opening 10 is defined by a recessed flange 15 which forms an open rectangular shape, closely approximating the transverse cross-section of the canister 20. The niche plate 6 at each opening 10 also carries a recessed ledge 38, spaced above the flange 15, for seating the scroll plate 8 thereon. Also provided are cast lugs 16, integral with niche plate 6 at each end of the niche opening 10. The lugs 16 have tapped holes 16 formed therein for securement of the scroll plate screws 11 to the niche plate 6. The previously described cut-out portions 26 of the canister flange 25 provide clearance between the securement lugs 16 and the flange 25 so that canister 20 can be fully inserted within the niche plate.

With the scroll plate 8 removed, the sealed canister 20 is inserted into the niche plate opening 10 until the tapered locking tabs 27 engage and lock at shoulder 28 beneath the niche opening flange 15 and the canister flange 25 bears against the niche flange 15 on its opposing surface, preventing any further inward movement of the canister within the interior 19 of the repository. Canister 20 is thus easily secured and locked in place within the niche plate 6 without the necessity of mechanical fasteners, special shelving or the like.

If, for some reason, it is necessary to move the cremated remains to another location at a later time, the task presents no special problems. The scroll plate 8 is removed and the canister 20 is withdrawn from the niche plate opening 10 by inwardly flexing the sidewalls 21 or 22 of the cannister so that the shoulders 28 of the locking tabs 27 are freed from engagement with the niche flange 15. The canister 20, with the lid 30 still sealably in place, can then be moved to its new repository without any of the difficulties encountered with similar prior art systems.

While the presently preferred embodiment of the canister 20 of my invention is shown and described as being rectangular in cross-sectional shape in order to fit within a previously established, standard-sized columbarium, it can be appreciated that the cross-section could also be square or circular if desired. Of course, if such a modification is made, the configuration of the niche plate opening would also have to be changed in order to conform to any new canister shape. In addition, the means for securing the canister to the niche plate could also be modified from the herein described spaced-apart and separate, canister flange and tapered locking tabs. The canister flange could be replaced by extending the locking tabs nearly to the top of the canister and forming a notch in the tabs to receive the niche plate flange therein (not shown). The notch would be located in the space between the shoulder of the locking tabs and the canister flange.

While a specific embodiment of my invention has been described in detail, it will be appreciated by those skilled in the art that various modifications to those details can be made in light of the teachings of the disclosure. Accordingly, the particular arrangement shown and described herein is meant to be illustrative only and not limiting as to the scope of the invention which is to be given the full breadth of the appended claims and any and all equivalents thereof.

What is claimed is:

1. A storage system for cremated remains comprising a generally flat niche plate having a plurality of openings therein and a plurality of scroll plates for individually covering each of said openings, the storage system including sidewalls for supporting the niche plate along its outer periphery and means for securing the niche plate to said sidewalls in spaced relationship from an inner surface extending between the sidewalls, said niche plate, sidewalls and inner surface defining an interment repository therewithin, said niche plate including a recessed flanged portion within each of the niche openings and a recessed ledge spaced above each of said flanged portions to receive one of said scroll plates thereon; the storage system further comprising an urn-like canister having resilient sidewalls, a closed bottom end and a continuous, open top edge, having a transverse cross-sectional shape substantially the same as each of said niche plate openings, said canister including lid means for closing-off said top edge, said canister further including outwardly projecting flange means formed around the periphery thereof in spaced relationship to the top edge thereof and further including a plurality of locking tab means formed on the sidewalls of the canister, each having a shoulder portion in spaced relationship from the canister flange means, said spacing being approximately equal to the thickness of the niche plate flange, whereby, when said canister is inserted into a niche plate opening to a predetermined depth within the interment repository, the canister flange means and the shoulders of the locking tab means bear against opposing surfaces of the niche plate flange to lockably secure said canister within the niche plate.

2. The storage system of claim 1 wherein the niche plate and scroll plate are constructed of cast bronze and the urn-like canister and lid means are formed from an injection molded plastic material, selected from the group consisting of polyethylene and polypropylene.

3. The storage system of claim 2 wherein the means for securing the scroll plates to the niche plate includes a pair of cast lugs formed within the niche plate adjacent to each opening therein, each of said lugs having a tapped hole formed therein to receive a threaded fastener for holding each of said scroll plates thereto.

4. The storage system of claim 1 wherein the transverse cross-sectional shape of the canister is that of a rectangle having a pair of opposed wide sidewalls and a pair of narrow sidewalls and wherein the tapered locking tabs are formed on the narrow sidewalls.

5. The storage system of claim 1 wherein the tapered locking tabs are formed on the wide sidewalls of the canister.

6. The storage system of claim 1 wherein the top edge of the canister includes a grooved detent formed continuously around the perimeter thereof, said lid means includes a crowned surface portion carrying inner and outer lipped edges for gripping engagement with the top edge of the canister, one of said lipped edges having an outwardly extending bead adapted to engage the grooved detent of the canister to improve the sealability thereof.

7. The storage system of claim 1, wherein the niche plate is secured to the supporting sidewalls in a horizontal plane and in an outdoor environment.

8. The storage system of claim 1, wherein the niche plate is secured to the supporting sidewalls in a vertical plane and in an outdoor environment.

* * * * *